US012727675B2

(12) United States Patent
Thompson

(10) Patent No.: US 12,727,675 B2
(45) Date of Patent: Sep. 8, 2026

(54) NECK PILLOW AND INTEGRATED SHAWL

(71) Applicant: Anika Thompson, Brooklyn, NY (US)

(72) Inventor: Anika Thompson, Brooklyn, NY (US)

( * ) Notice: Subject to any disclaimer, the term of this patent is extended or adjusted under 35 U.S.C. 154(b) by 145 days.

(21) Appl. No.: 18/653,639

(22) Filed: May 2, 2024

(65) Prior Publication Data

US 2025/0338965 A1 Nov. 6, 2025

(51) Int. Cl.

| | |
|---|---|
| ***A47C 7/38*** | (2006.01) |
| ***A41D 23/00*** | (2006.01) |
| ***A41D 27/20*** | (2006.01) |

(52) U.S. Cl.

CPC ..... *A47C 7/383* (2013.01); *A41D 23/00* (2013.01); *A41D 27/20* (2013.01)

(58) Field of Classification Search

CPC . A47G 9/066; A47G 9/06; A47G 9/10; A47C 7/383; A41D 23/00

See application file for complete search history.

(56) References Cited

U.S. PATENT DOCUMENTS

| | | | | |
|---|---|---|---|---|
| D695,996 | S | 12/2013 | Paul | |
| D836,287 | S | 12/2018 | Melamed | |
| 10,292,508 | B1 | 5/2019 | Kim | |
| 10,390,623 | B2 | 8/2019 | Konigsberg | |
| 10,875,425 | B1 | 12/2020 | Ashu | |
| 10,945,544 | B2 | 3/2021 | Lee | |
| 12,075,936 | B2 * | 9/2024 | Voegel | A47C 7/383 |
| 12,446,715 | B1 * | 10/2025 | Wright | A47G 9/1045 |
| 2002/0166173 | A1 * | 11/2002 | Brown | A47G 11/001 5/639 |
| 2009/0133192 | A1 * | 5/2009 | Hassell | A47C 7/383 5/639 |
| 2014/0000036 | A1 * | 1/2014 | Cohen | A47C 27/081 5/639 |
| 2017/0208881 | A1 | 7/2017 | Leathers | |
| 2021/0353083 | A1 | 11/2021 | Ali | |
| 2023/0255284 | A1 * | 8/2023 | Lefebvre | A41D 17/005 2/171 |
| 2023/0329460 | A1 * | 10/2023 | Fenner | A47G 9/0223 |

FOREIGN PATENT DOCUMENTS

| | | |
|---|---|---|
| WO | WO2021072179 | 4/2021 |

* cited by examiner

*Primary Examiner* — David R Dunn

(57) ABSTRACT

A neck pillow apparatus for supporting a head of a user and facilitating warming the user includes a C-shaped support for receiving a neck of the user and supporting the head of the user. A shawl is attached to an outer side of the support and is positionable to drape around the user while the neck is received into the support to drape the user and keep the user warm.

7 Claims, 6 Drawing Sheets

NECK PILLOW AND INTEGRATED SHAWL

BACKGROUND OF THE INVENTION

(1) Field of the Invention

The disclosure relates to neck pillows and more particularly pertains to a new neck pillow for supporting a head of a user and facilitating warming the user.

(2) Description of Related Art Including Information Disclosed Under 37 CFR 1.97 and 1.98

The prior art describes several examples of neck pillows which store or attach to a blanket. Many of these apparatuses include a closable pouch for storing the blanket. However, the blanket is often of a size that makes folding and storing the blanket a cumbersome task. Further, the blankets of such apparatuses are often positioned such that they significantly change the shape of the neck pillow, which affects how the neck pillow supports the head of the user. The prior art, however, does not disclose such a neck pillow which has a shawl attached to a rear side and a pair of lateral sides of the neck pillow and has a pouch positioned on the rear and lateral sides to hold the shawl when not in use.

Such a device is advantageous over the prior art in that it allows for a smaller blanket to be positioned over the shoulders of a user without shifting significantly due to being attached to the neck pillow. Further, the placement of the pouch on the rear and lateral sides does not impact a vertical thickness or vertical compressibility of the neck pillow when storing the shawl. The placement of the pouch also does not impinge on the neck of the user like pouches open on an inner side of some neck pillow devices.

BRIEF SUMMARY OF THE INVENTION

An embodiment of the disclosure meets the needs presented above by generally comprising a support with a body which has a C-shape such that the body is configured to receive a neck of a user into a recess defined by the body. An opening to the recess is positioned on a front side of the support. The body comprising a resiliently compressible material such that the body is configured to cushion a head of the user when the head rests on the body. A shawl has a proximal edge with respect to the support. The proximal edge is coupled to the support and extends along a rear side and a pair of lateral sides of the support. The shawl is positionable in a use position wherein the shawl extends downwardly from the support and defines a cavity below the support. The shawl comprising a flexible shawl material such that the shawl is configured to drape around the user when positioned in the use position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
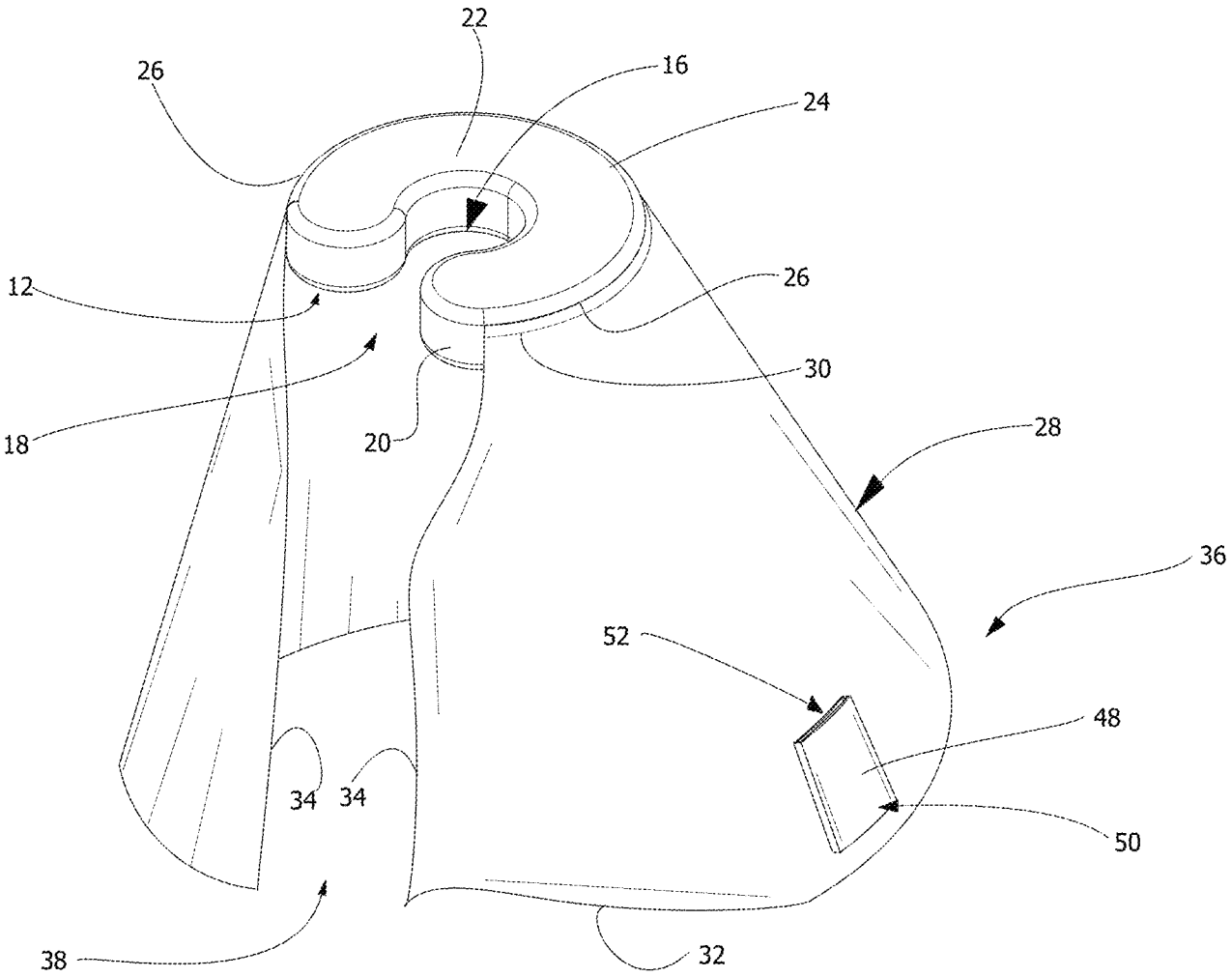
FIG. 1 is a perspective view of a neck pillow apparatus according to an embodiment of the disclosure.
Figure 3:
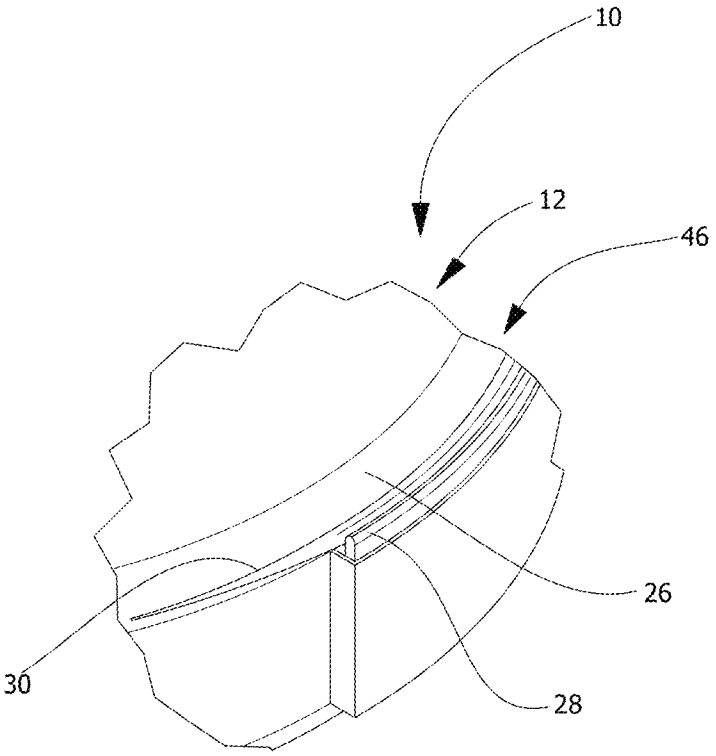
FIG. 3 is a detail view of an embodiment of the disclosure taken from Circle 3 in FIG. 2.
Figure 2:
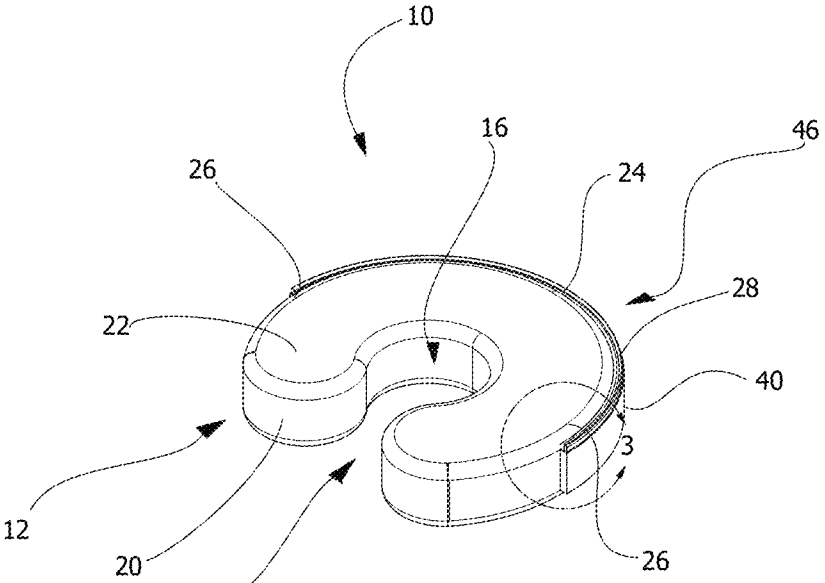
FIG. 2 is a perspective view of an embodiment of the disclosure.
Figure 5:
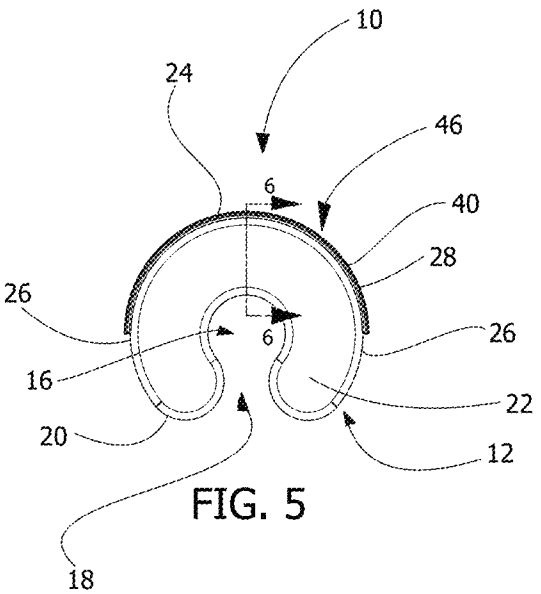
FIG. 5 is a top view of an embodiment of the disclosure.
Figure 4:
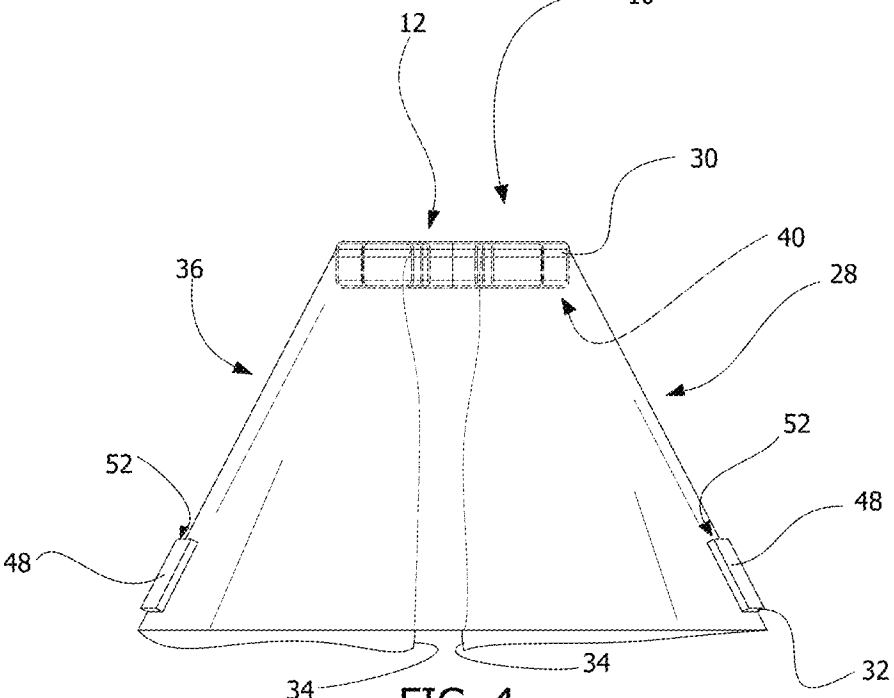
FIG. 4 is a rear view of an embodiment of the disclosure.
Figure 6:
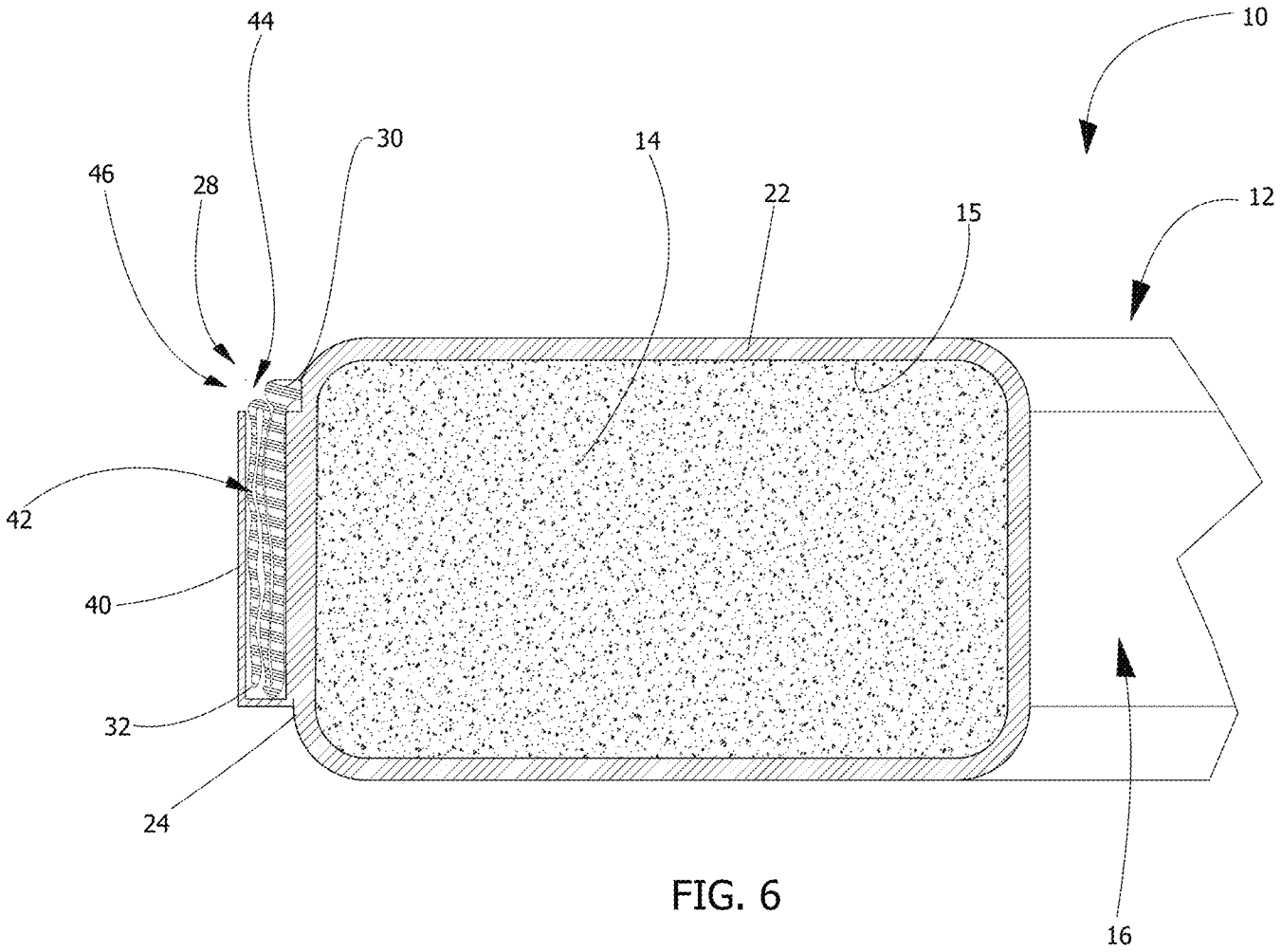
FIG. 6 is a cross-section view of an embodiment of the disclosure taken from Arrows 6-6 in FIG. 5.
Figure 7:
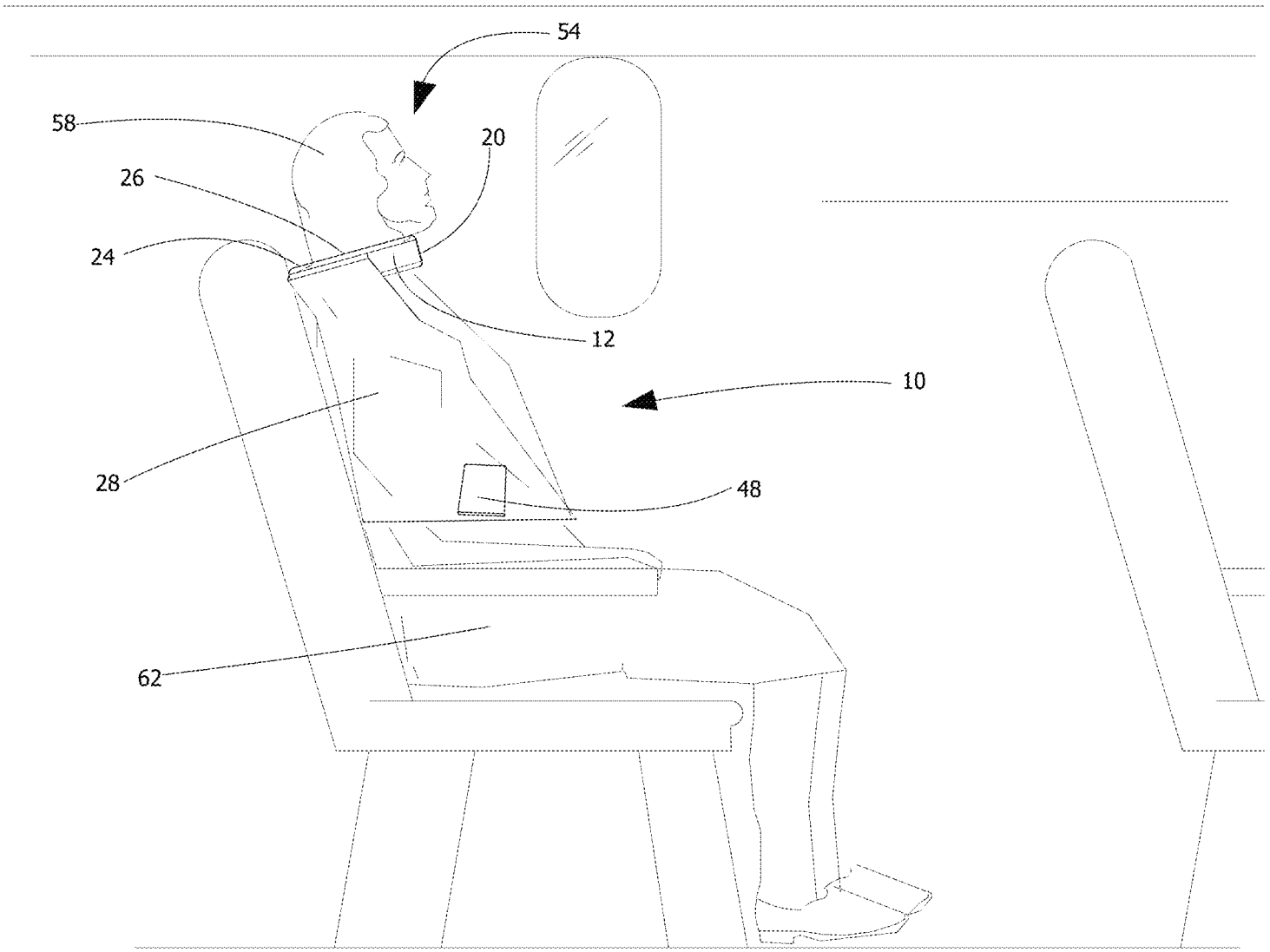
FIG. 7 is a side in-use view of an embodiment of the disclosure.
Figure 8:
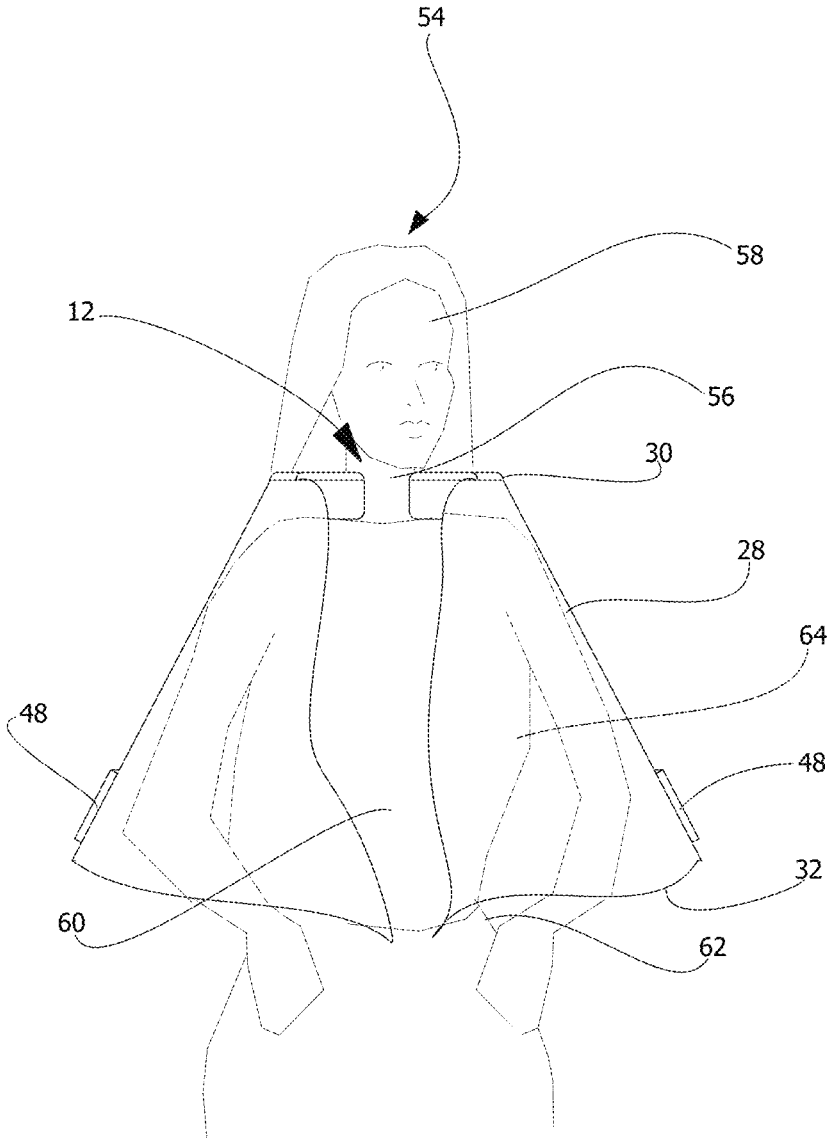
FIG. 8 is a front in-use view of an embodiment of the disclosure.

With reference now to the drawings, and in particular to FIGS. 1 through 8 thereof, a new neck pillow embodying the principles and concepts of an embodiment of the disclosure and generally designated by the reference numeral 10 will be described.

As best illustrated in FIGS. 1 through 8, the neck pillow apparatus 10 generally comprises a support 12 with a body 14 that has a C-shape such that the body 14 is configured to receive a neck 56 of a user 54 into a recess 16 defined by the body 14. An opening 18 to the recess 16 is positioned on a front side 20 of the support 12. The body 14 comprises a resiliently compressible material such that the body 14 is configured to cushion a head 58 of the user 54 when the head 58 rests on the body 14. The support 12 further includes a cover 22 which surrounds the body 14 and conforms to an exterior surface 15 of the body 14. The cover 22 comprises a flexible cover material such that the cover 22 is configured to conform to the head 58 of the user 54 when the head 58 rests against the cover 22 over the body 14. The resiliently compressible material of the body 14 may comprise a polymer foam, a down, a cotton stuffing, or the like. The flexible cover material may comprise any conventional fabric made of synthetic or natural fibers, or a combination thereof.

A shawl 28 is provided which has a proximal edge 30 with respect to the support 12. The proximal edge 30 is coupled to the support 12 and extends along a rear side 24 and a pair of lateral sides 26 of the support 12. The shawl 28 is positionable in a use position 36 wherein the shawl 28 extends downwardly from the support 12 and defines a cavity 38 below the support 12. The shawl 28 has a length from the proximal edge 30 to a distal edge 32 with respect to the support 12 such that the shawl 28 is configured to extend over a majority of a length of a torso 60 of the user 54 when the recess 16 receives the neck 56 of the user 54 and the shawl 28 is positioned in the use position 36. The length of the torso 60, for purposes of the present invention, is measured from the neck 56 of the user 54 to a hip 62 of the user 54. The length of the shawl 28 may, for example, be long enough that the shawl 28 extends past each one of a pair of elbows of the user 54 when the recess 16 receives the neck 56 of the user 54, the shawl 28 is positioned in the use position 36, and each elbow of the pair of elbows is positioned in abutment with an associated lateral surface 64 of a pair of lateral surfaces 64 of the torso 60 of the user 54.

The distal edge 32 has a length greater than a length of the proximal edge 30 such that the shawl 28 tapers from the distal edge 32 to the proximal edge 30. The shawl 28 has a pair of free edges 34 extending between the distal edge 32 and the proximal edge 30, each of which is straight. The shawl 28 comprises a flexible shawl material such that the shawl 28 is configured to drape around the user 54 when positioned in the use position 36. The flexible shawl material may comprise any conventional fabric made of synthetic or natural fibers, or a combination thereof. Typically, the flexible shawl material will be selected for thermally insulating properties such that the shawl 28 slows a loss of heat from the cavity 38 during use to keep the user 54 warm.

A pouch 40 is coupled to the support 12 and extends along the rear side 24 and the pair of lateral sides 26 of the support 12. The pouch 40 is positioned below the proximal edge 30 of the shawl 28. The pouch 40 defines an internal space 42 therein which has an open top end 44. The shawl 28 is positionable in a stored position 46 wherein the shawl 28 extends into the internal space 42 of the pouch 40 from the proximal edge 30. A pair of pockets 48 is coupled to the shawl 28 and is positioned on a side of the shawl 28 which faces outwardly from the cavity 38 when the shawl 28 is positioned in the use position 36. Each pocket 48 of the pair of pockets 48 defines an interior space 50 therein and has an open end 52 which faces away from the distal edge 32 of the shawl 28.

In use, the neck 56 of the user 54 is inserted into the recess 16 of the body 14 such that the front side 20 of the support 12 faces forwardly with respect to the user 54. The shawl 28 is positioned in the use position 36 such that the shawl 28 drapes over and around the torso 60 of the user 54. The user 54 may draw the pair of free edges 34 of the shawl 28 toward each other to more tightly wrap the torso 60 of the user 54 with the shawl 28. The user 54 may rest the head 58 of the user 54 against the support 12. To store the shawl 28, at least a portion of the shawl 28 is placed into the pouch 40. The neck pillow apparatus 10 may also be used only to rest the head 58 of the user 54 when the shawl 28 is held in the pouch 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A neck pillow apparatus comprising:

a support comprising a body having a C-shape such that the body is configured to receive a neck of a user into a recess defined by the body, an opening to the recess being positioned on a front side of the support, the body comprising a resiliently compressible material such that the body is configured to cushion a head of the user when the head rests on the body;

a shawl having a proximal edge with respect to the support, the proximal edge being coupled to the support, the proximal edge extending along a rear side and a pair of lateral sides of the support, the shawl being positionable in a use position wherein the shawl extends downwardly from the support and defines a cavity below the support, the shawl comprising a flexible shawl material such that the shawl is configured to drape around the user when positioned in the use position; and a pouch being coupled to the support and extending along the rear side and the pair of lateral sides of the support, the pouch being positioned below the proximal edge of the shawl, the pouch defining an internal space therein which has an open top end, the shawl being positionable in a stored position wherein the shawl extends into the internal space of the pouch from the proximal edge.

2. The apparatus of claim 1, wherein the distal edge has a length greater than a length of the proximal edge such that the shawl tapers from the distal edge to the proximal edge.

3. The apparatus of claim 2, wherein the shawl has a pair of free edges extending between the distal edge and the proximal edge, each free edge of the pair of free edges being straight.

4. The apparatus of claim 1, wherein the support further comprises a cover surrounding the body, the cover conforming to an exterior surface of the body, the cover comprising a flexible cover material such that the cover is configured to conform to the head of the user when the head rests against the cover over the body.

5. The apparatus of claim 1, further comprising a pair of pockets being coupled to the shawl, the pair of pockets being positioned on a side of the shawl which faces outwardly from the cavity when the shawl is positioned in the use position, each pocket of the pair of pockets defining an interior space therein, the interior space of each pocket of the pair of pockets having an open end facing away from the distal edge of the shawl.

6. The apparatus of claim 1, wherein the shawl has a length from the proximal edge to a distal edge with respect to the support such that the shawl is configured to extend over a majority of a length of a torso of the user when the recess receives the neck of the user and the shawl is positioned in the use position.

7. A neck pillow apparatus comprising:

a support comprising:

a body having a C-shape such that the body is configured to receive a neck of a user into a recess defined by the body, an opening to the recess being positioned on a front side of the support, the body comprising a resiliently compressible material such that the body is configured to cushion a head of the user when the head rests on the body; and a cover surrounding the body, the cover conforming to an exterior surface of the body, the cover comprising a flexible cover material such that the cover is configured to conform to the head of the user when the head rests against the cover over the body;

a shawl having a proximal edge with respect to the support, the proximal edge being coupled to the support, the proximal edge extending along a rear side and a pair of lateral sides of the support, the shawl being positionable in a use position wherein the shawl extends downwardly from the support and defines a cavity below the support, the shawl having a length from the proximal edge to a distal edge with respect to the support such that the shawl is configured to extend over a majority of a length of a torso of the user when the recess receives the neck of the user and the shawl is positioned in the use position, the distal edge having a length greater than a length of the proximal edge such that the shawl tapers from the distal edge to the proximal edge, the shawl having a pair of free edges extending between the distal edge and the proximal edge, each free edge of the pair of free edges being straight, the shawl comprising a flexible shawl material such that the shawl is configured to drape around the user when positioned in the use position;

a pouch being coupled to the support and extending along the rear side and the pair of lateral sides of the support, the pouch being positioned below the proximal edge of the shawl, the pouch defining an internal space therein which has an open top end, the shawl being positionable in a stored position wherein the shawl extends into the internal space of the pouch from the proximal edge; and a pair of pockets being coupled to the shawl, the pair of pockets being positioned on a side of the shawl which faces outwardly from the cavity when the shawl is positioned in the use position, each pocket of the pair of pockets defining an interior space therein, the interior space of each pocket of the pair of pockets having an open end facing away from the distal edge of the shawl.

* * * * *